US009929508B2

(12) United States Patent
Puhl et al.

(10) Patent No.: US 9,929,508 B2
(45) Date of Patent: Mar. 27, 2018

(54) ELECTRICAL CONNECTOR

(71) Applicant: Delphi Technologies, Inc., Troy, MI (US)

(72) Inventors: Ronald A. Puhl, Poland, OH (US); Faviola Ramon, Coahuila (MX)

(73) Assignee: DELPHI TECHNOLOGIES, INC., Troy, MI (US)

( * ) Notice: Subject to any disclaimer, the term of this patent is extended or adjusted under 35 U.S.C. 154(b) by 0 days.

(21) Appl. No.: 15/499,491

(22) Filed: Apr. 27, 2017

(65) Prior Publication Data

US 2017/0338593 A1 Nov. 23, 2017

Related U.S. Application Data

(60) Provisional application No. 62/339,135, filed on May 20, 2016.

(51) Int. Cl.
*H01R 13/639* (2006.01)
*H01R 13/627* (2006.01)
*H01R 13/66* (2006.01)

(52) U.S. Cl.
CPC ..... *H01R 13/639* (2013.01); *H01R 13/6272* (2013.01); *H01R 13/6666* (2013.01)

(58) Field of Classification Search
CPC ..... H01R 13/6275; H01R 13/6272
USPC ..... 439/357, 358
See application file for complete search history.

(56) References Cited

U.S. PATENT DOCUMENTS 4,621,885 A * 11/1986 Szczesny ..... H01R 13/508 439/357
5,934,926 A * 8/1999 Gabrisko, Jr. ..... H01R 13/506 439/357
5,944,550 A 8/1999 Vindigni
5,964,624 A * 10/1999 Pernelle ..... H01R 9/26 439/357
7,503,793 B2 3/2009 Morello
7,549,887 B1 * 6/2009 Ng ..... H01R 13/6272 439/352

FOREIGN PATENT DOCUMENTS

EP 848456 A2 6/1998
EP 2482390 A2 8/2012
FR 2756669 A1 6/1998
WO 2010068293 A1 6/2010

* cited by examiner

*Primary Examiner* — Gary Paumen
(74) *Attorney, Agent, or Firm* — Robert J. Myers

(57) ABSTRACT

An electrical connector system is presented herein. The electrical connector system includes a first connector body containing a first plurality of terminals and a second connector body containing a second plurality of terminals that are configured to interconnect with the first plurality of terminals. The second connector body is configured to receive the first connector body. The electrical connector system further includes a locking feature configured to secure the first connector body to the second connector body in a pre-staged position in which the first plurality of terminals is not connected to the second plurality of terminals and further configured to secure the first connector body to the second connector body in a staged position in which the first plurality of terminals is connected to the second plurality of terminals after disengaging the locking feature in the pre-staged condition.

8 Claims, 4 Drawing Sheets

ELECTRICAL CONNECTOR

CROSS-REFERENCE TO RELATED APPLICATION

This application claims the benefit under 35 U.S.C. § 119(e) of U.S. Provisional Patent Application No. 62/339,135, filed on May 20, 2016, the entire disclosure of which is hereby incorporated by reference.

TECHNICAL FIELD OF INVENTION

The invention generally relates to connector systems and more particularly relates to a connector system configured to retain the connector system in both a mechanically connected and electrically unconnected (pre-staged) condition and a mechanically and electrically connected (staged) condition.

BACKGROUND OF THE INVENTION

Connector bodies of connection systems have traditionally been designed to be easily inserted to one another with minimal engagement force needed to complete their mating. Once the connector bodies are successfully mated, the intent of a traditional connection system is to travel together easily with minimal effort and no secondary operation to complete the connection is required.

These traditional designs will not work for an application where the connection is required to be locked in pre-staged position in which the connector bodies are mated but connector elements, such as electrical terminals, within the connector bodies are disconnected and not able to travel to a staged position in which the connector elements are connected or disconnected without a secondary operation being performed by an operator at the same time. For the operators protection, the secondary operation is a requirement before being able to move the system to the staged position.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with one embodiment of this invention, an electrical connector system is provided. The electrical connector system includes a first connector body containing a first plurality of terminals and a second connector body containing a second plurality of terminals configured to interconnect with the first plurality of terminals. The second connector body is configured to receive the first connector body. The electrical connector system further includes a locking feature configured to secure the first connector body to the second connector body in a pre-staged position in which the first plurality of terminals is not connected to the second plurality of terminals and further configured to secure the first connector body to the second connector body in a staged position in which the first plurality of terminals is connected to the second plurality of terminals after disengaging the locking feature in the pre-staged condition.

The locking feature may further include a latch defined by the first connector body having a leading edge and a trailing edge and a flexible lock arm pivotably attached to the second connector body by a resilient U-shaped strap. The lock arm is configured to engage the leading edge of the latch, thereby securing the first connector body in the pre-staged position. The lock arm is further configured to engage the trailing edge of the latch after disengaging the lock arm from the latch in the pre-staged condition, thereby securing the first connector body in the staged position. The leading edge of the latch may not be angled away from the lock arm. The locking feature may further include a stop defined by the first connector body and configured to engage the U-shaped strap, thereby inhibiting removal of the first connector body from the second connector body.

The second connector body contains first and second electrical terminals attached to first and second wire cables respectively. The first connector body may contain a shunt connector that is configured to interconnect the first and second electrical terminals when the first and second connector bodies are in the staged position. The shunt connector is further configured to disconnect the first electrical terminal from the second electrical terminal when the first and second connector bodies are in the pre-staged position. The first and second wire cables may be connected to a high voltage interlock (HVIL) system.

The electrical connector system may further include a lock out feature that is configured to prevent the first connector body from being moved from the pre-staged position to the staged position regardless of the locking feature. The lock out feature may include a solid planar tab extending from the first connector body and a pair of perforated planar tabs extending from the second connector body each defining an aperture aligned with one another. The perforated planar tabs are arranged so that the solid planar tab can slide between the pair of perforated planar tabs as the first connector body is moved from the pre-staged to the staged position. An object inserted within the aperture will block the solid planar tab from sliding between the perforated planar tabs, thereby inhibiting the first connector body from being moved from the pre-staged position to the staged position.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

A connector system is presented herein. This connector system incorporates a lock-out feature that protects an operator from unintentionally moving the connector bodies of the connector system from a pre-staged position in which the connector bodies are mated but connector elements, such as electrical terminals, within the connector bodies are disconnected to staged position in which the connector elements are connected. In the pre-staged position, the two connector bodies are locked together so that cannot be disconnected from one another but cannot be moved to the staged position without simultaneously activating a lock-out feature while pushing the two connector bodies together.

Such a connector system may be used as part of a high voltage interlock (HVIL) system that controls whether an associated high voltage circuit, e.g. an output of a battery pack in an electrical vehicle, is energized based on the connection state of the connector system. The connector system described herein addresses a problem of energizing the high voltage circuit due to inadvertent connection of the connector system that may pose causes a safety risk by adding a locking feature to the connection system that will not allow plug connector body to be moved from the pre-staged position to the staged position without activating the locking feature.

Figure 1:
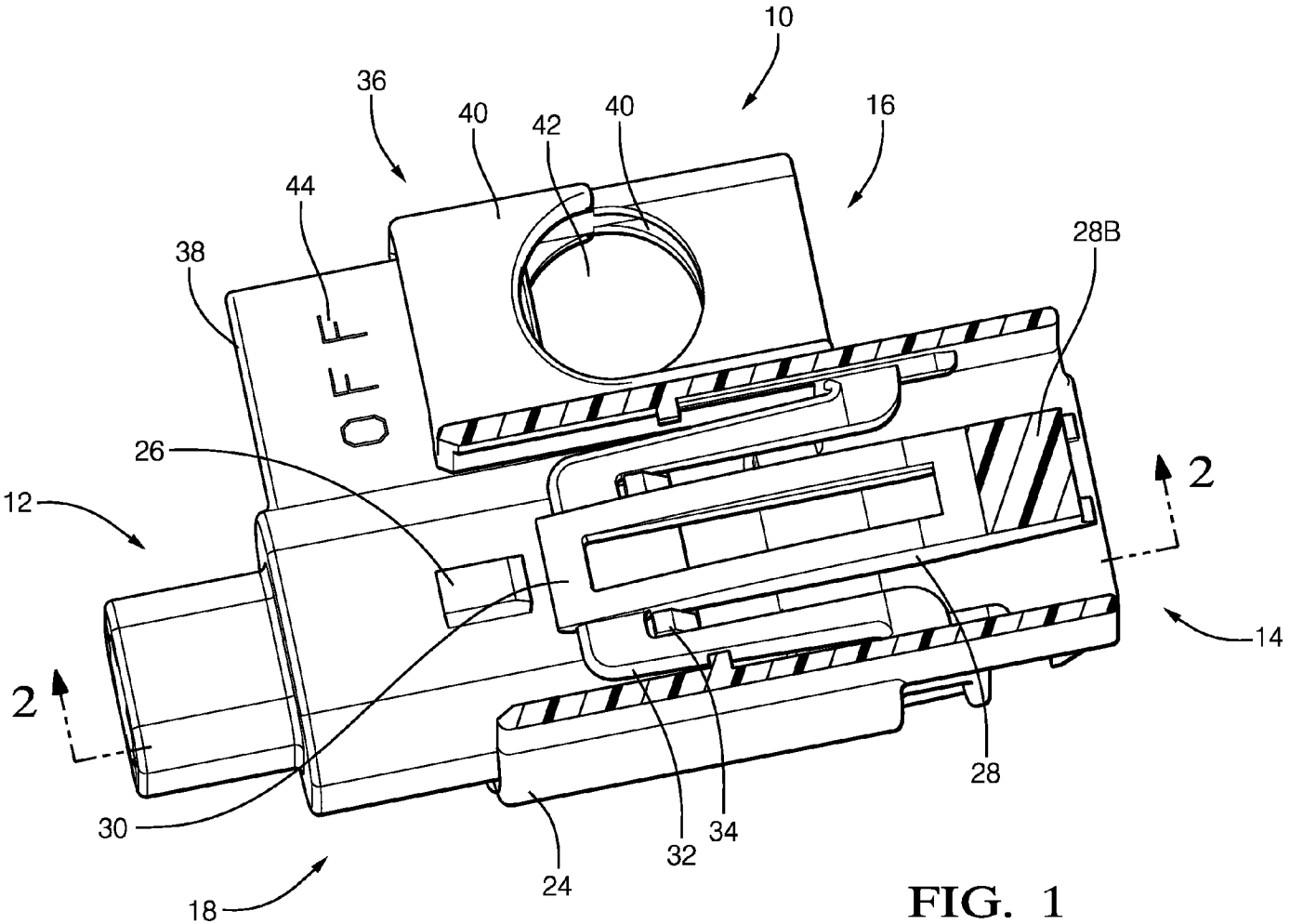
FIG. 1 is perspective view of a connector system in a pre-staged position in accordance with one embodiment.
Figure 2:
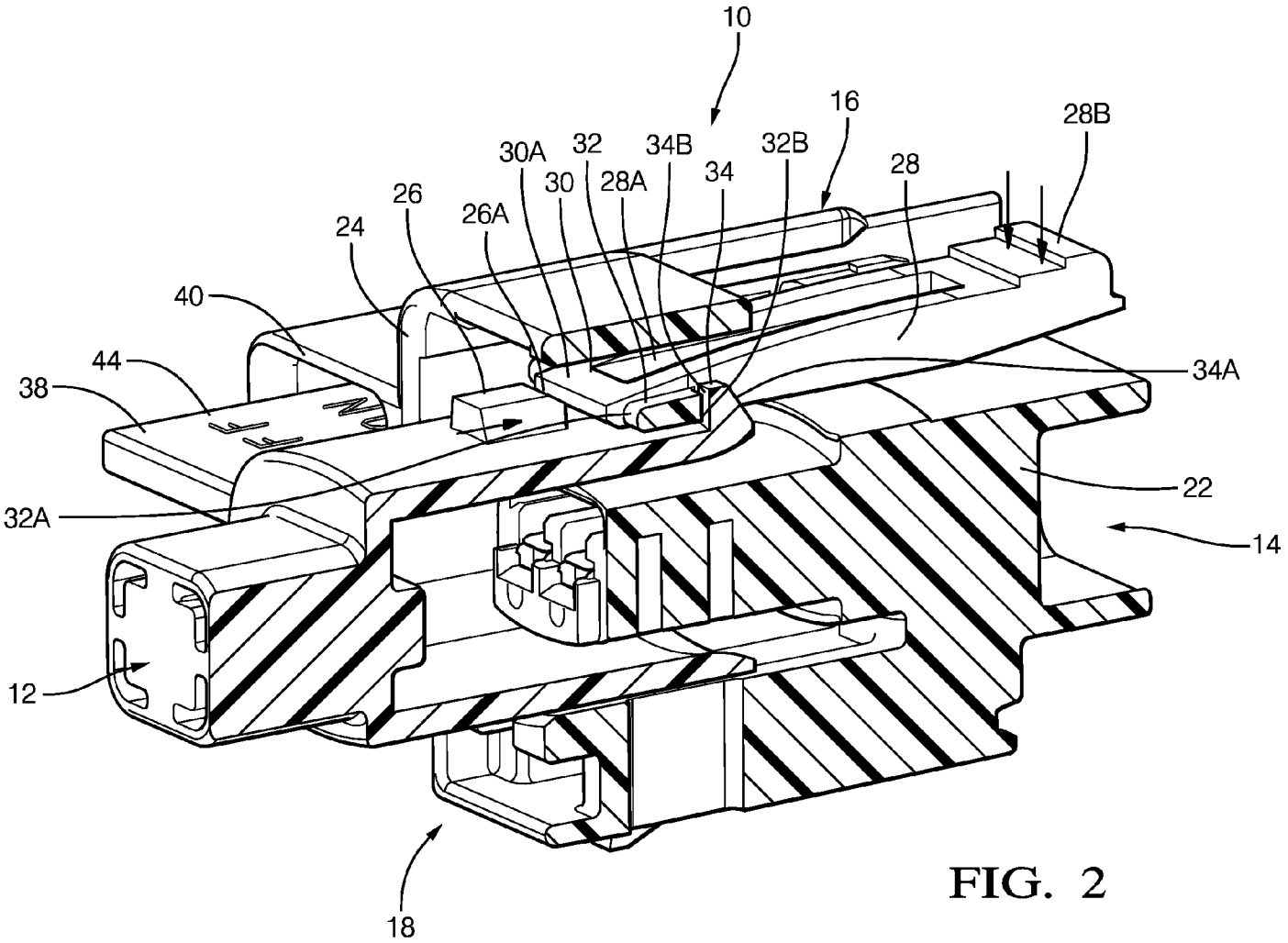
FIG. 2 is a cutaway view of the connector system of FIG. 1 in the pre-staged position in accordance with one embodiment.
Figure 3:
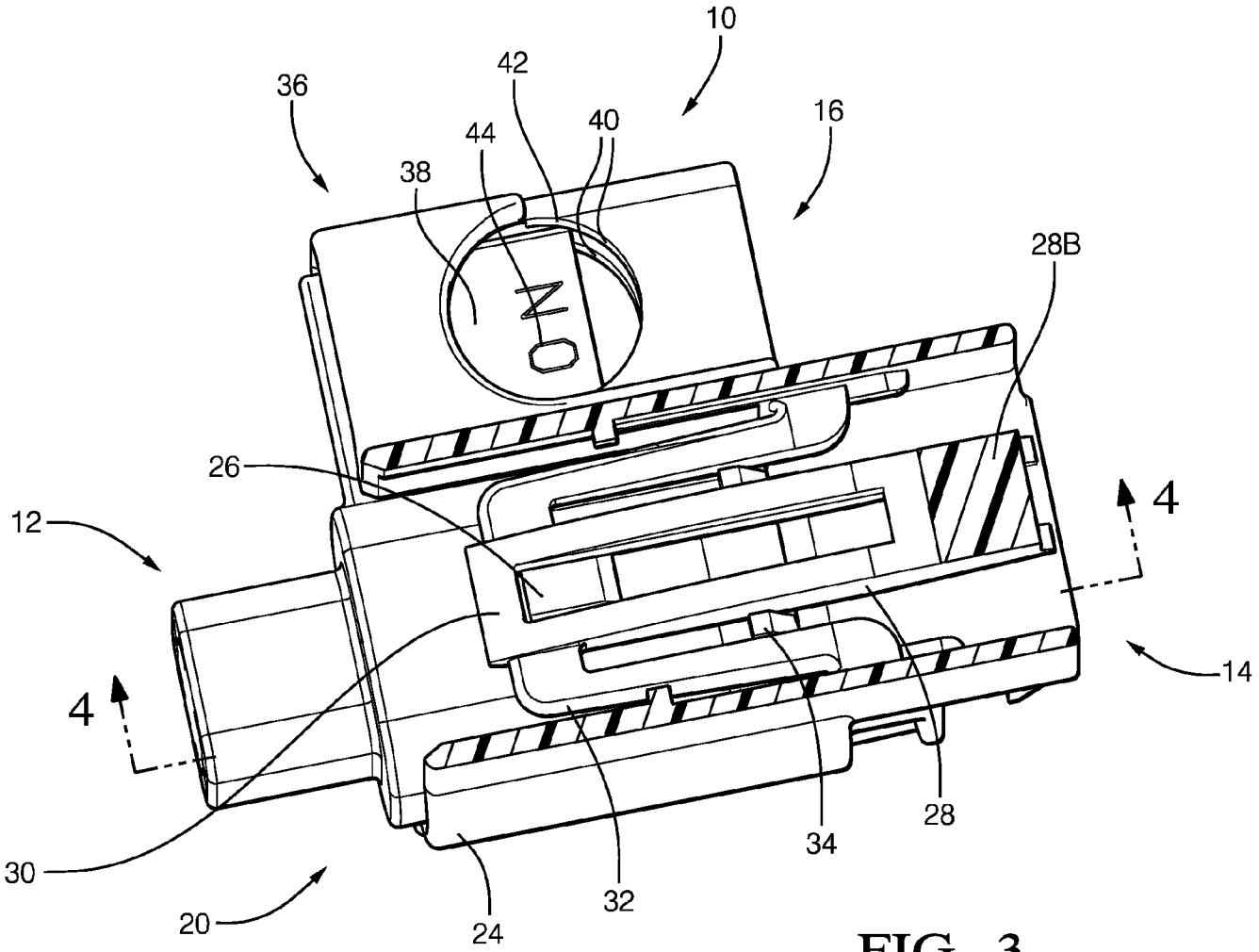
FIG. 3 is a perspective view of the connector system of FIG. 1 in a staged position in accordance with one embodiment.
Figure 4:
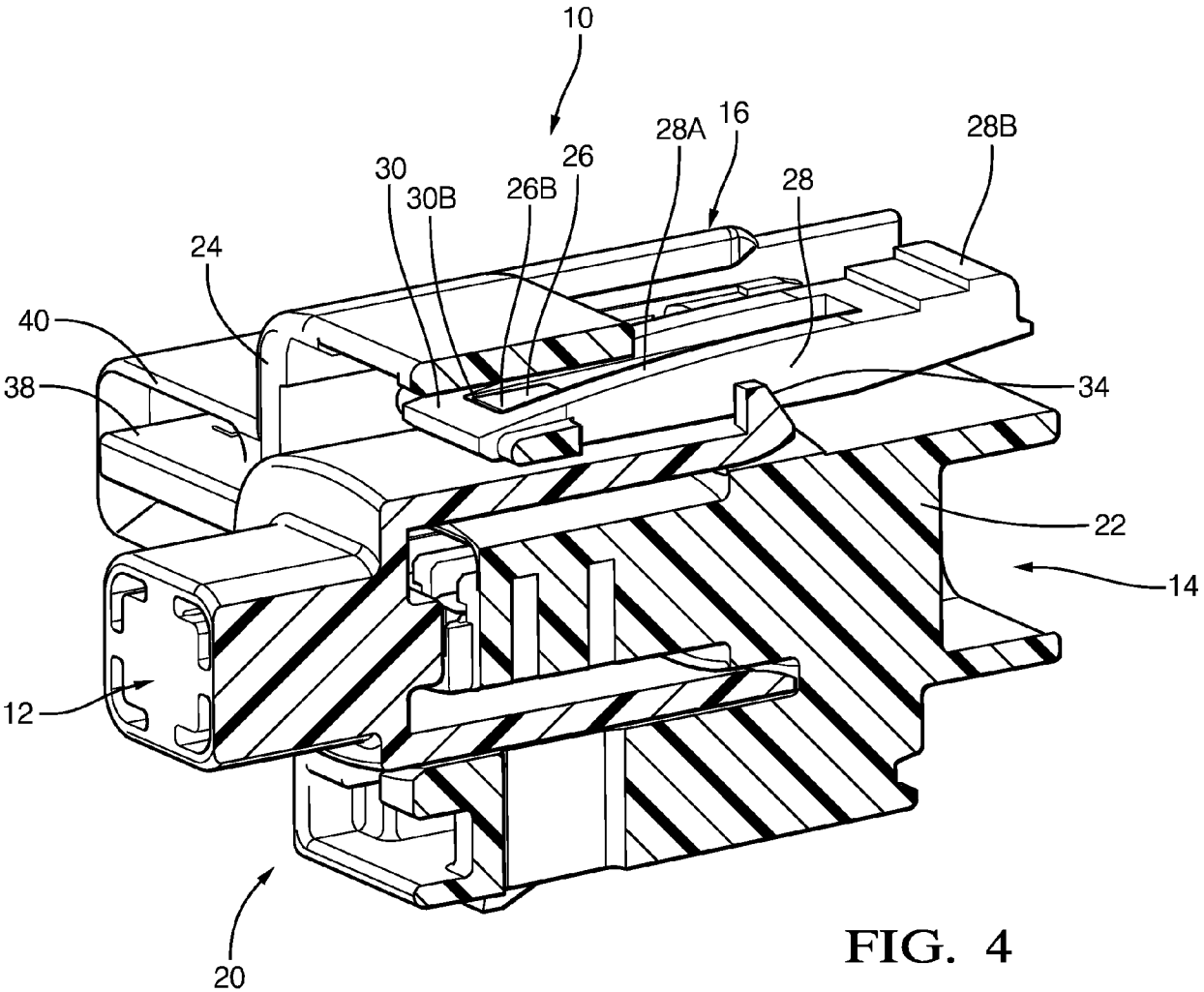
FIG. 4 is a cutaway view of the connector system of FIG. 1 in the staged position in accordance with one embodiment.

FIGS. 1 through 4 illustrate a non-limiting example of connector system 10 having a plug connector body 12, a socket connector body 14 configured to mate with the plug connector body 12, and a locking feature 16 that is configured to secure the plug connector body 12 to the socket connector body 14 in a pre-staged position 18 shown in FIGS. 1 and 2 and further configured to secure the plug connector body 12 to the socket connector body 14 in a staged position 20 shown in FIGS. 3 and 4. The socket connector body 14 contains first and second female electrical terminals (not shown) that are connected to first and second wire cables (not shown) or other electrical conductors, e.g. bus bars or circuit board traces (not shown). The plug connector body 12 contains a shunt terminal (not shown) having two male pins (not shown) configured to interface with the female terminals that are electrically connected (shunted) to one another. In the illustrated example, the shunt terminal is not connected to any wire cables or other electrical conductors outside of the plug connector body 12.

The socket connector body 14 includes a terminal housing 22 defining terminal cavities (not shown) extending through the terminal housing 22 for receiving the first and second female terminals therein. The socket connector body 14 also has a shroud 24 that at least partially surrounds the terminal housing 22 and can be integrally or separately connected to the terminal housing 22 in any suitable manner. The shroud 24 defines a socket for receiving the plug connector.

The plug connector body 12 defines a lock tab 26 that extends outwardly from the plug connector body 12 and has a leading edge 26A and a trailing edge 26B designated relative to the direction of insertion of the plug connector body 12 into the shroud 24 of the socket connector body 14. The socket connector body 14 includes a longitudinally extending lock arm 28 pivotably attached to the socket connector body 14. A first end 28A of the lock arm 28 defines a lock nib 30 also having a leading edge 30A and a trailing edge 30B, again designated relative to the direction of insertion of the plug connector body 12 into the shroud 24 of the socket connector body 14. The lock arm 28 is integrally connected to the socket connector body 14 by a resilient U-shaped strap 32 that is configured to impose a hold-down force on the first end 28A of the lock arm 28 when the lock arm 28 is pivoted from a state of rest by pressing a second end 28B of the lock arm 28 opposite the first end 28A. When the lock arm 28 is in the state of rest and the connector system 10 is in the pre-staged position 18, the leading edge 30A of the lock nib 30 will engage the leading edge 26A of the lock tab 26. When the lock arm 28 is in the state of rest and the connector system 10 is in the staged position 20, the trailing edge 30B of the lock nib 30 will engage the trailing edge 26B of the lock tab 26.

The leading edge 26A of the lock tab 26 is substantially parallel to the leading edge 30A of the lock nib 30. As used herein, substantially parallel means±10° of absolutely parallel. In the illustrated example, the leading edge 26A of the lock tab 26 is substantially perpendicular to the surface of the plug connector body 12 from which it protrudes. As used herein, substantially perpendicular means±10° of absolutely perpendicular. The leading edge 30A of the lock nib 30 is also substantially perpendicular to the top surface of the lock arm 28. The leading edge 26A of the lock tab 26 is not angled away from the leading edge 30A of the lock nib 30. Also, the leading edge 30A of the lock nib 30 is not angled toward the leading edge 26A of the lock tab 26. In alternative embodiments, the leading edge of the lock tab may be angled toward the leading edge of the lock nib and the leading edge of the lock nib may be angled away from the leading edge of the lock tab. Without subscribing to any particular theory of operation, the leading edges in the configuration described above create a mechanical interference when the first and socket connector bodies are pushed from the pre-staged position 18 toward the staged position 20, thus preventing movement of the plug connector body 12 relative to the socket connector body 14.

Similarly, the trailing edge 26B of the lock tab 26 is substantially parallel to the trailing edge 30B of the lock nib 30. In the illustrated example, the trailing edge 26B of the lock tab 26 is substantially perpendicular to the surface of the plug connector body 12 from which it protrudes. The trailing edge 30B of the lock nib 30 is also substantially perpendicular to the top surface of the lock arm 28. The trailing edge 26B of the lock tab 26 is not angled away from the trailing edge 30B of the lock nib 30. Also, the trailing edge 30B of the lock nib 30 is not angled toward the trailing edge 26B of the lock tab 26. In alternative embodiments, the trailing edge of the lock tab may be angled toward the trailing edge of the lock nib and the trailing edge of the lock nib may be angled away from the trailing edge of the lock tab. Without subscribing to any particular theory of operation, the trailing edges in the configuration described above create a mechanical interference when the first and socket connector bodies are pushed from the staged position 20 toward the pre-staged position 18, thus preventing movement of the plug connector body 12 relative to the socket connector body 14.

To move the plug connector from the pre-staged position 18 to the staged position 20 or from the staged position 20 to the pre-staged position 18, an operator (not shown) manually depresses the second end 28B of the lock arm 28, causing the first end 28A of the lock arm 28 to pivot upward and away from the plug connector body 12 so that the lock nib 30 no longer engages the lock tab 26. When the lock nib 30 is disengaged from the lock tab 26, the plug connector body 12 may be moved from the pre-staged position 18 to the staged position 20 or from the staged position 20 to the pre-staged position 18.

The plug connector body 12 also defines a pair of stops 34 projecting from the connector body having leading edges 34A and trailing edges 34B, here again designated relative to the direction of insertion of the plug connector body 12 into the shroud 24 of the socket connector body 14. When the plug connector body 12 is initially mated with the socket connector body 14, the angled leading edges 34A of the stops 34 raise the U-shaped strap 32 allowing the stops 34 to pass under the U-shaped strap 32. After the stops 34 pass under the U-shaped strap 32, the U-shaped strap 32 returns to its rest position. Engagement of the trailing edges 34B of the stops 34 inhibit removal of the plug connector body 12 from the socket connector body 14 once mated and restrict further movement of the plug connector body 12 once it reaches the pre-staged position 18. The leading edges 34A of the stops 34 are angled away from leading edges 32A of the U-shaped strap 32 and trailing edges 34B of the stops 34 are substantially parallel to trailing edges 32B of the U-shaped strap 32.

As best shown in FIGS. 1 and 3, the plug connector body 12 has a lock out feature 36 that includes a planar plug tab 38 extending from one side of the plug connector body 12. The lock out feature 36 also includes at least one and preferably two planar socket tabs 40 extending from the socket connector body 14 and arranged so that the plug tab 38 can slide between the socket tabs 40 as the plug connector body 12 is moved from the pre-staged position 18 to the staged position 20. The socket tabs 40 define a pair of apertures 42 aligned with one another that are configured to accept a lock out pin (not shown) that may be in the form of a screwdriver shaft or hasp of a padlock. When the lock out pin is inserted within the apertures 42, the plug tab 38 is inhibited from sliding between the socket tabs 40, thereby preventing the plug connector from being moved from the pre-staged position 18 to the staged position 20. This can serve as a secondary means of preventing adverting movement of the plug connector to the staged position 20. The plug tab 38 may also include graphics 44 to indicate the status of the connector position of the circuit to which the connector system 10 is connected.

The connector system 10 may further include a connector position assurance device (not shown) that is configured to prevent inadvertent activation of the lock arm 28.

Accordingly, a connector system 10 is provided. The connector system 10 provides the benefits of a locking feature 16 may be built into the connection system utilizing the primary connector latch portion of the design. There may be a series of lock and latches on the first and socket connector bodies that work together to provide the locking feature 16. The connector system 10 allows the connection to be unmated from the staged position 20 to the pre-staged position 18 multiple times. In the pre-staged position 18, the connector system 10 is locked in a position that does not allow electrical continuity to continue. The connector system 10 remains locked in its pre-staged position 18 until the operator needs to reconnect the connector system 10. At that time, the locking feature 16 would again need to be activated to allow the connector system 10 to return to the staged position 20.

While the illustrated example only includes electrical terminals connected to wire cables in the socket connector, other embodiments may be envisioned in which only the plug connector includes electrical terminals connected to wire cables or both the plug and socket connectors include electrical terminals connected to wire cables The examples presented herein are directed to electrical connector systems. However, other embodiments of the connector system may be envisioned that are adapted for use with optical cables or hybrid connections including both electrical and optical cables. Yet other embodiments of the connector system may be envisioned that are configured for connecting pneumatic or hydraulic lines.

While this invention has been described in terms of the preferred embodiments thereof, it is not intended to be so limited, but rather only to the extent set forth in the claims that follow. Moreover, the use of the terms first, second, upper, lower, etc. does not denote any order of importance or orientation, but rather the terms first, second, upper, lower, etc. are used to distinguish one element from another. Furthermore, the use of the terms a, an, etc. do not denote a limitation of quantity, but rather denote the presence of at least one of the referenced items.

We claim:

1. An electrical connector system comprising:

a first connector body containing a first plurality of terminals;

a second connector body containing a second plurality of terminals configured to interconnect with the first plurality of terminals, said second connector body configured to receive the first connector body;

a locking feature configured to secure the first connector body to the second connector body in a pre-staged position in which the first plurality of terminals is not connected to the second plurality of terminals and further configured to secure the first connector body to the second connector body in a staged position in which the first plurality of terminals is connected to the second plurality of terminals after disengaging the locking feature in the pre-staged condition; and a lock out feature configured to prevent the first connector body from being moved from the pre-staged position to the staged position regardless of the locking feature.

2. The electrical connector system according to claim 1, wherein the lock out feature includes a solid planar tab extending from the first connector body and a pair of perforated planar tabs extending from the second connector body each defining an aperture aligned with one another, wherein the perforated planar tabs are arranged so that the solid planar tab can slide between the pair of perforated planar tabs as the first connector body is moved from the pre-staged to the staged position.

3. The electrical connector system according to claim 2, wherein an object inserted within the aperture will block the solid planar tab from sliding between the perforated planar tabs, thereby inhibiting the first connector body from being moved from the pre-staged position to the staged position.

4. The electrical connector system according to claim 1, wherein the locking feature comprises:

a latch defined by the first connector body having a leading edge and a trailing edge; and a flexible lock arm pivotably attached to the second connector body by a resilient U-shaped strap, said lock arm configured to engage the leading edge of the latch, thereby securing the first connector body in the pre-staged position and further configured to engage the trailing edge of the latch after disengaging the lock arm from the latch in the pre-staged condition, thereby securing the first connector body in the staged position.

5. The electrical connector system according to claim 4, wherein the leading edge of the latch is not angled away from the lock arm.

6. The electrical connector system according to claim 4, wherein the locking feature further comprises a stop defined by the first connector body and configured to engage the U-shaped strap, thereby inhibiting removal of the first connector body from the second connector body.

7. The electrical connector system according to claim 1, wherein the second connector body contains first and second electrical terminals attached to first and second wire cables respectively, wherein the first connector body contains a shunt connector configured to interconnect the first and second electrical terminals when the first and second connector bodies are in the staged position and wherein the shunt connector is configured to disconnect the first electrical terminal from the second electrical terminal when the first and second connector bodies are in the pre-staged position.

8. The electrical connector system according to claim 7, wherein the first and second wire cables are connected to a high voltage interlock (HVIL) system.

* * * * *